United States Patent [19]

Wyman et al.

[11] Patent Number: 4,479,751

[45] Date of Patent: Oct. 30, 1984

[54] RECEPTACLE DUMPING APPARATUS

[75] Inventors: James H. Wyman, Easley; Robert E. Wyman, Mauldin, both of S.C.

[73] Assignee: T C I Products, Inc., Easley, S.C.

[21] Appl. No.: 332,149

[22] Filed: Dec. 18, 1981

[51] Int. Cl.[3] ..... B65F 3/02

[52] U.S. Cl. ..... 414/406; 74/101; 74/106; 414/420; 414/421

[58] Field of Search ..... 414/303, 406, 408, 420–422; 74/101, 106

[56] References Cited

U.S. PATENT DOCUMENTS

| | | | |
|---|---|---|---|
| 3,804,277 | 4/1974 | Brown et al. | 414/303 |
| 3,894,642 | 7/1975 | Shive | 414/303 |
| 4,365,922 | 12/1982 | Borders | 414/406 |

*Primary Examiner*—Robert G. Sheridan

*Attorney, Agent, or Firm*—Bailey & Hardaway

[57] ABSTRACT

Dumping apparatus is illustrated wherein a novel compound linkage system is employed in which a first link is pivoted to move a receptacle and the like as to be dumped to an intermediate position and thereafter through movement of a second link the receptacle is raised to dumping position, but only after a latch mechanism to positively position the receptacle is secured through a novel lost motion coupling.

10 Claims, 7 Drawing Figures

RECEPTACLE DUMPING APPARATUS

BACKGROUND OF THE INVENTION

Refuse containers which are rollable as by residential users to a position accessible for automatic dumping are increasing in popularity. The cost of auxiliary equipment which is necessitated, as well as the manual labor incident to the use thereof is also increasing. Hydraulic dumping apparatus carried by the garbage truck has been expensive due to complex linkage mechanisms. The receptacles are normally positioned by placing an upper bar into a receiving mechanism carried by the hydraulic dumping apparatus on a substantially vertical or upright carriage, and a latching mechanism carried by the carriage engages a lower latching bar positioned below the first mentioned upper bar carried by the receptacle. Such an apparatus is illustrated in U.S. Pat. Nos. 3,804,277 and 3,894,642. In such apparatus not only is the linkage for raising the receptable complicated, but the latching mechanism is not sufficiently positive.

Another typical example is that manufactured by Zarn, Inc., Post Office Box 1350, Reidsville, N.C. 27320, which employs a manually controlled hydraulic circuit such as is schematically illustrated herein for use with apparatus constructed in accordance with the present invention. The Zarn apparatus, as in most prior art systems, employs a continuously movable latch mechanism and employs a positive action at all times during the lowering of the receptacle which results in damage to the receptacle or hydraulic mechanism should an obstruction such as a rock, be encountered by the receptacle while it is being lowered. Since movement of the latch continues during the lifting, the latch or hook overtravels in order to achieve the necessary hooking action. The invention hereof is an improvement upon the current hydraulic or automatic dumping mechanisms.

Accordingly, it is an important object of this invention to provide positive and increased lifting power through sequentially operated linkage.

Another important object of the invention is to provide a positive latching means for fixing the receptacle with respect to the lifting and tilting carriage by securing a positive motion which occurs earlier in the lifting cycle and which is provided with lost motion means for eliminating overtravel of the securing hook.

Another important object of the invention is to provide a lifting mechanism which incorporates a safety feature to prevent damage to the receptacle by discontinuing the lifting linkage from the cylinder so that if the receptacle meets resistance on its downward cycle, the lifting carriage will merely pivot freely avoiding damage to the can or mechanism.

SUMMARY OF THE INVENTION

It has been found that a simple and inexpensive linkage mechanism may be constructed in order to afford increased lifting power to a container unit such as a rolling garbage can or the like by providing a first link which is pivoted to raise a lifting carriage to an intermediate position preparatory to a second link taking over to exert through a vertical thrust of the cylinder a lifting extension together with a positive latching action upon the can. The latching action occurs through a lost motion coupling for commencing upon the attaining of the predetermined intermediate position just before action of the second link takes over in lifting the can.

The invention contemplates tilting apparatus having novel linkage suitable for lifting a receptacle through imparting a pivoting motion to a lifting carriage thereby raising the carriage to an intermediate position and thereafter shifting the lifting radius to a second linkage means for thereupon actuating the latching mechanism while continuing the lifting action with the latching mechanism fully engaged.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
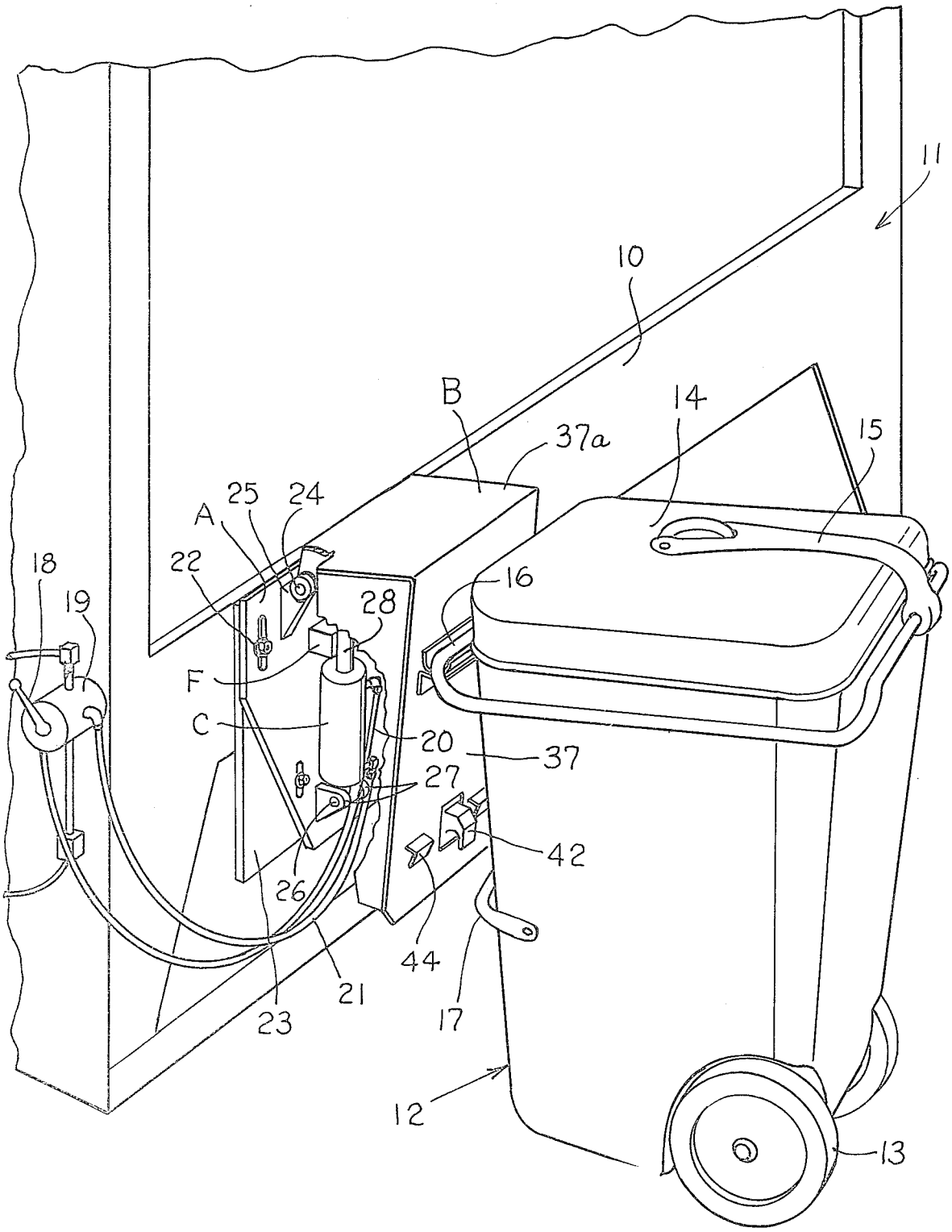
FIG. 1 is a perspective view schematically illustrating a dumping apparatus constructed in accordance with the invention positioned on a dump truck preparatory to lifting a roll-about garbage container and the like, FIG. 2 is a fluid or hydraulic circuit diagram which is conventional for previous dumping apparatus of which this is an improvement.
Figure 3:
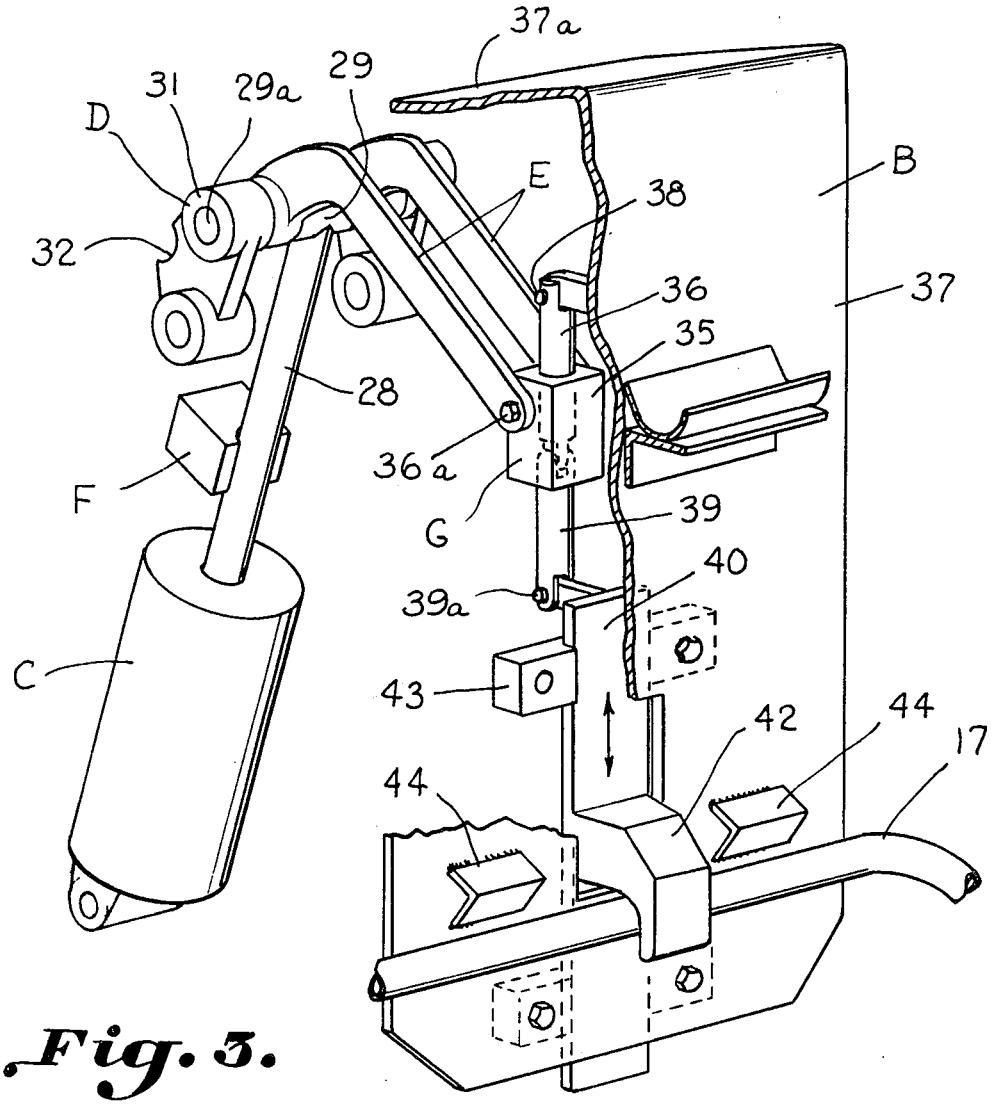
FIG. 3 is a perspective view illustrating the power operated linkage mechanism hereof.

A receptacle dumping apparatus which is attachable to a refuse truck and the like is illustrated in the drawings. A horizontal support member 10 is carried by the refuse truck, which is broadly designated at 11 in FIG. 1. A trash can or refuse container is broadly designated at 12 which includes wheels 13 and a cover 14 which is attached by a movable connecting member 15 which permits the lid to fall open by the force of gravity for dumping the contents into the garbage truck 11. The garbage can has an upper horizontal bar 16 which serves as a handle for pushing or pulling the assembly upon the wheels 13. A lower horizontal bar 17 is provided for serving as a latching bar for being positively engaged for positioning the refuse container unit or garbage can 12 against the tiltable lifting carriage of the dumping mechanism.

The lifting or dumping apparatus hereof includes a vertical support plate A which is secured to the back of the dump truck in a conventional position. The dumping apparatus further includes a carriage B which is pivotally carried by the support A. A fluid motor has a cylinder C which is pivoted on a base portion upon the support plate and is extensible for connection to a first linkage means D, as well as a second linkage means E which has a common pivotal connection with the first linkage means D. A stop F is provided in the form of a half-moon bearing for engaging extensible means connected with the cylinder C for limiting inward pivotal movement of the cylinder toward the plate A so as to initiate movement of the second linkage means E upon attainment of an intermediate or mid position of the linkage. A toggle mechanism G is illustrated for latching the receptacle upon the carriage B for dumping responsive to mcvement of the linkage E. After latching and the toggle action is discontinued, a free sliding action occurs and the mechanism serves as a lost motion coupling.

Figure 2:
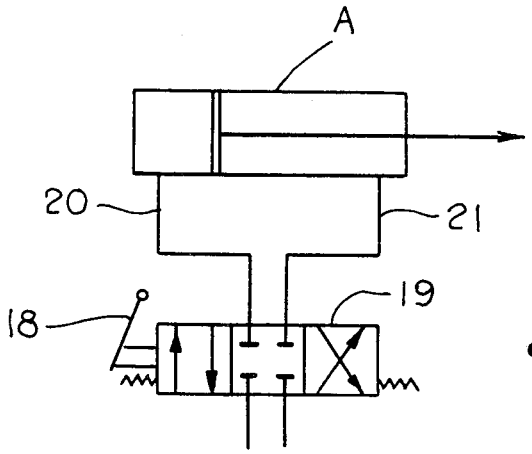

A manually operable control lever is illustrated at 18 in FIGS. 1 and 2 for actuating the double acting valve means 19 which through the lines 20 and 21, control fluid flow to the cylinder A. Referrring more particularly to FIG. 1, the vertical mounting or support plate A is secured as by bolts 22 carried in slots 22*a* of the support plate A to the usual vertical plate 23 which is suitably connected as by welding to the cross brace 10 of the dump truck.

Figure 4:
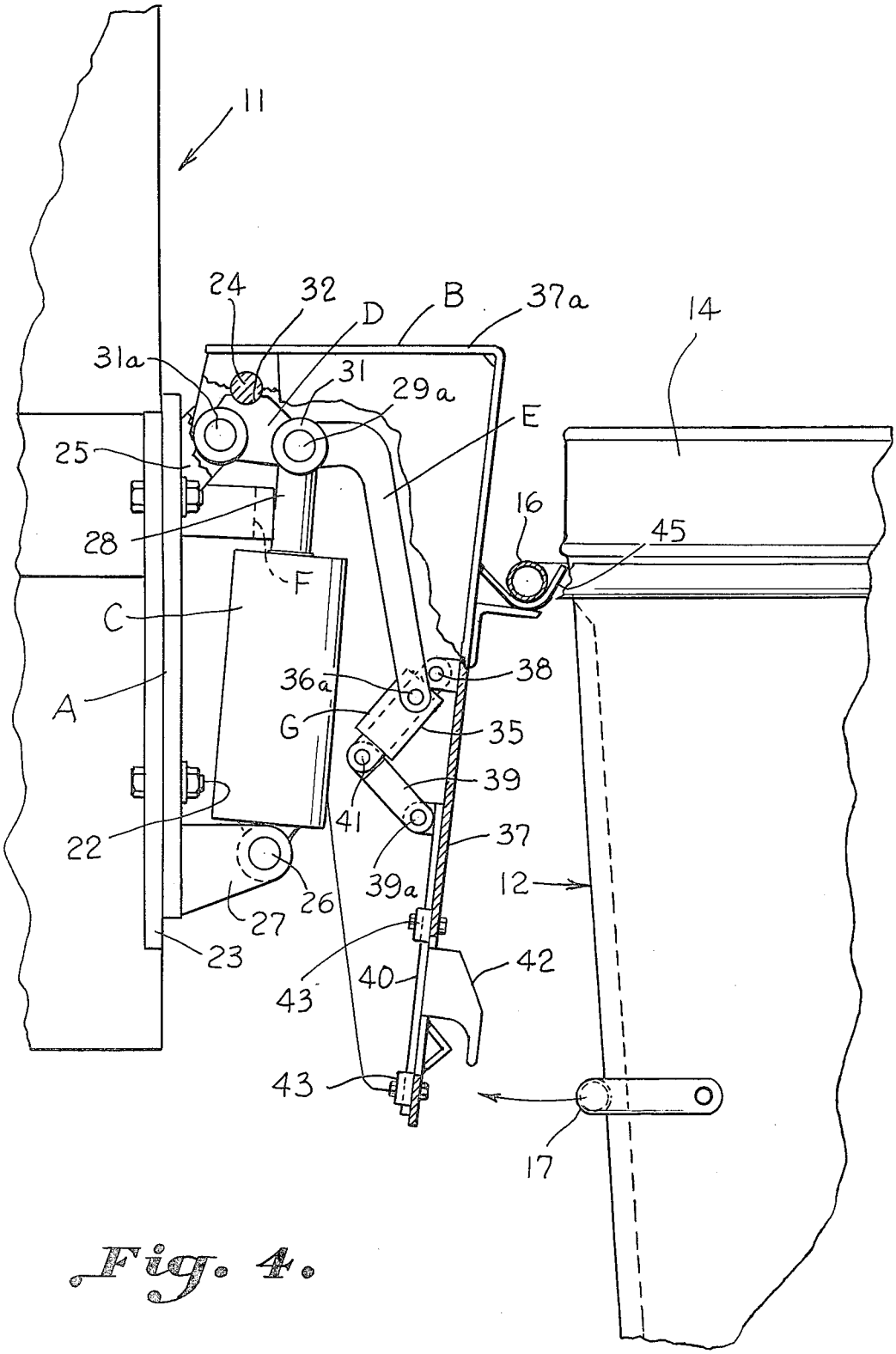
FIG. 4 is a side elevation illustrating the lifting mechanism in position for receiving a container for dumping.
Figure 5:
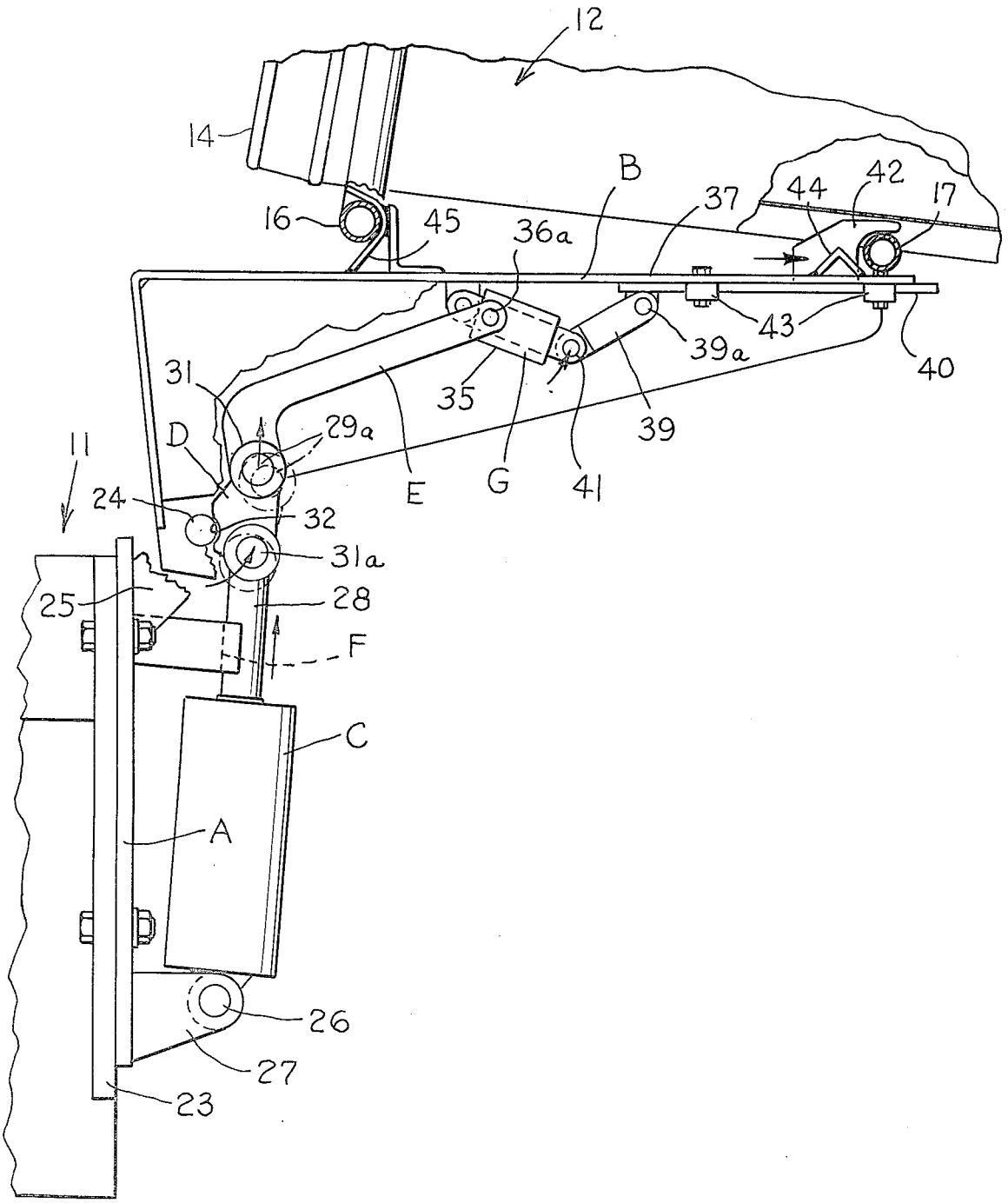
FIG. 5 is a side elevation similar to FIG. 4 illustrating the linkage mechanism in mid or predetermined intermediate position during the dumping cycle.

The tiltable carriage B is pivoted as at 24 upon spaced brackets 25 secured as by welding to the support plate A. The stationary pins 24 carry the spaced brackets 30 for pivotal movement thereon. The hydraulic cylinder C has pivotal connection as at 26 with the brackets 27 fixedly carried by the support plate A. The cylinder C includes an extensible piston rod 28 which extends upwardly for pivotal connection through a sleeve 29 to a pin 29*a* which pivotally carries the first links D and second links E. The links D each have pivotal connection on a pin 31*a* carried on one end on the bracket 30 and on the other end on the bracket 30*b* which is fixedly carried by the carriage B. On the other end, the first link D is pivotally connected as at 31 to the second linkage E through the pin 29*a*. Between the ends of the link D a bearing segment 32 (FIGS. 3, 4, 5 and 6) is carried for engagement upon the pin 24 carried by the bracket 25 and extending through the brackets 30 and 30*b* upon which the carriage B is pivotally mounted. The free ends of the bell crank linkage E are pivotally connected to a slide member 35 which is carried upon a first link 36 of a toggle linkage which includes a second link 39. The ends of the toggle linkage G are pivotally connected on one end to the substantially upright plate 37 of the carriage B as at 38. The other end of the toggle linkage is pivotally connected as at 39*a* to a slide member 40. The links 36 and 39 are pivotally connected on adjacent ends as at 41 (FIGS. 4 and 5). The slide 40 carries a downwardly opening hook 42 extending through a slot in the plate 37 of the carriage, and the slide has spaced retaining members 43 carried by the carriage for maintaining guiding alignment of the slide member 40 at all times. A deflector 44 is carried by the carriage beneath the hook 42 so as to guard against bouncing of the fastening bar 17 into the hook member upon being lowered. In other words, the member 44 serves as a deflector to prevent damage by guiding the fastening bar 17 outwardly away from the hook member during lowering of the container. It will be noted that a receiving member 45 is carried by an upper portion of the upright plate 37*a* of the carriage B in order to receive the upper handlebar portion 16 of the receptacle 12 preparatory to dumping of the refuse container.

Operation

Upon actuation of the fluid or hydraulic mechanism through actuation of the operator lever or handle 18, a dumping action is initiated wherein the piston rod 28 extends so as to pivot the first link D from its initial or de-activated position of FIG. 4, about its pivotal attachment to the brackets 25 so that the intermediate arcuate portion 32 of the link D engages the pin 24 fixedly carried by the brackets 25. The upward movement of the piston rod 28 continues until mid or intermediate position of the linkage as illustrated in FIG. 5 is achieved. In FIG. 5, the link D is illustrated as being substantially vertical with the intermediate arcuate portion 32 still in bearing engagement with the fixed pin 24 carried upon the mounting plate A. Upon attaining the mid position illustrated in FIG. 5, the arcuate portion 32 leaves the pin 24 by reason of the fact that the piston rod 28 engages the half-moon bearing F, preventing further inward tilting of the cylinder C upon its pivot point 26. At mid point, the arcuate surface 32 leaves the pin 24 and the pivotal motion continues about the pivot point 31*a* raising the pivot point 31 moving the linkage E upwardly moving the pivot point 36*a* at the remote end thereof outwardly, or to the right in FIG. 5, causing the link 36 to flatten creating a toggle action with the link 39 until the hook is engaged with the latching handle 17 to positively position the can upon the carriage plate 37. After latching is achieved through relatively short movement of the link E, the slide member 35 will extend over the link 39 and the pivot point 41 to form a lost motion coupling so that further movement of the link toggle would result in any further movement of the latch 42 which is thus placed in positive latching engagement at a relatively early point of the dumping cycle.

Figure 6:
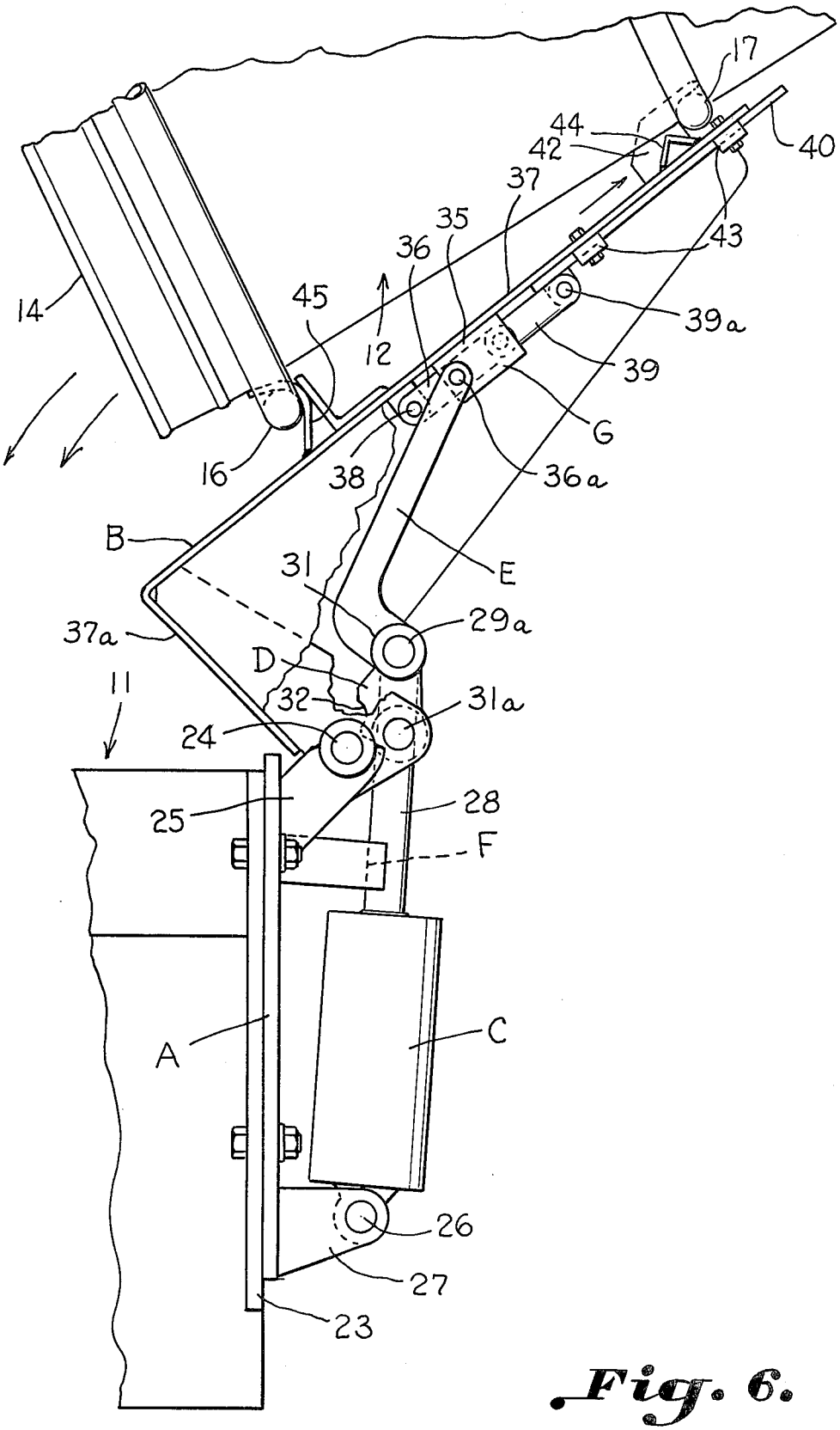
FIG. 6 is a side elevation similar to FIGS. 4 and 5 illustrating the parts in fully raised position during the dumping cycle.
Figure 7:
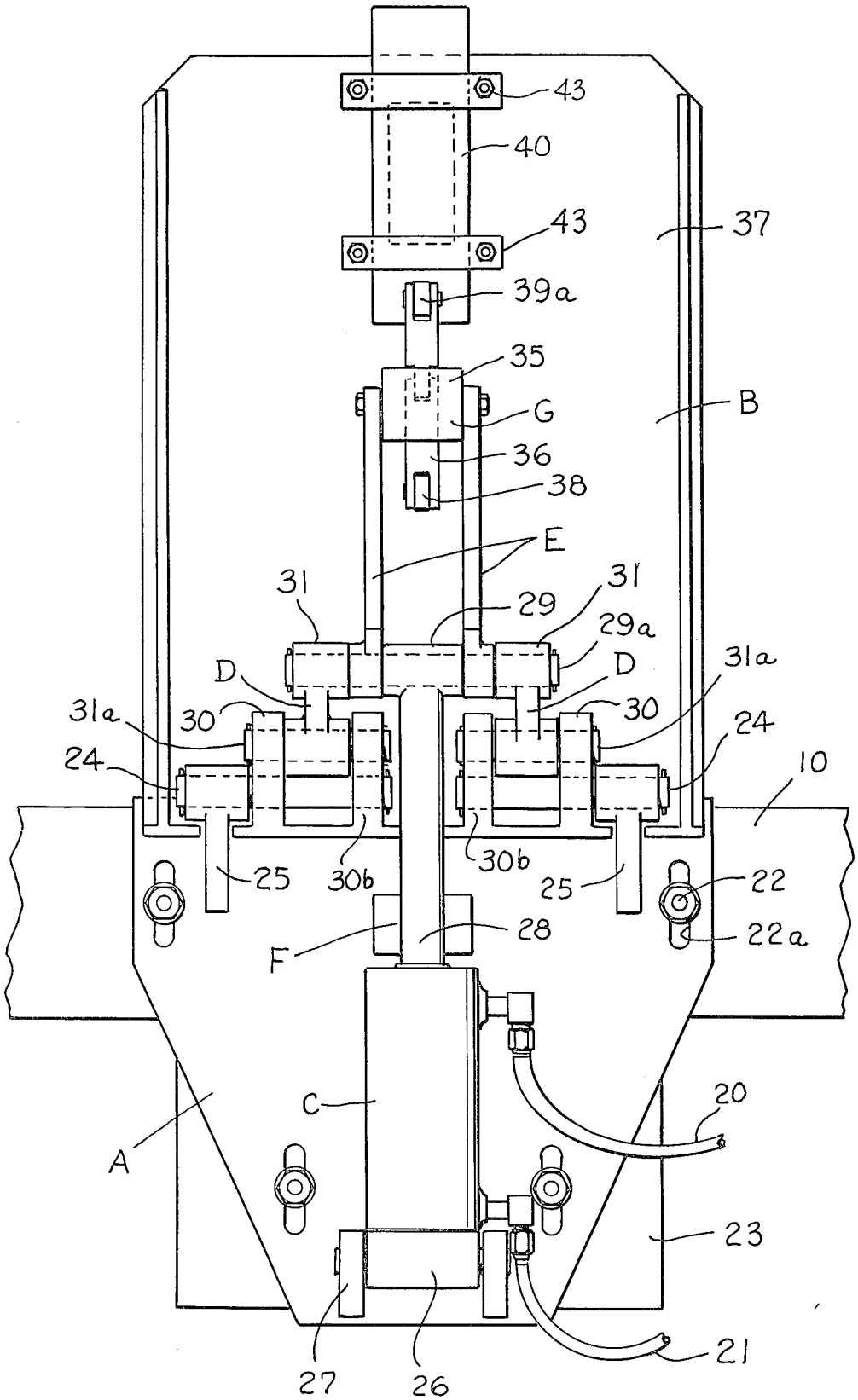
FIG. 7 is a rear elevation looking toward the underside of the lifting carriage which for purposes of illustration, is shown in vertical position rather than fully raised position as in FIG. 6.

FIG. 6 illustrates the parts in fully extended dumping position with the pivot point 29*a* in its elevated position, and the first link D in substantially vertical position.

It will be noted that at mid position on the upstroke, two things occur. First, the latch starts to close because the linkage mechanism stops pushing and starts pulling so that in other words, the arcuate portion 32 of the link D comes off its radius point 24 and the link E moves upwardly. Secondly, the piston rod 28 engages the moon bearing F to prevent further inward pivoting of the cylinder D resulting in substantially vertical movement of the linkage as indicated by the arrow in FIG. 5. Further upward movement of the piston rod results in relative outward movement of the linkage D closing the sliding latch through a modified toggle action until the linkage is flattened permitting free sliding movement of the sliding member 35, whereupon the toggle action is discontinued upon latching and the device becomes a lost motion coupling permitting further raising of the carriage and the receptacle carried thereby without further movement of the latch 42.

After the carriage and the receptacle carried thereby have reached the full elevated position with the linkage positioned as shown in FIG. 6 and a downward stroke is commenced, mid position is again achieved when the linkage D again engages its radius point or pin 24 and the piston rod leaves the moon bearing F.

At a point just below mid position a center line passing through the pivot point 26 of the cylinder and the lifting point of the pin 29*a* falls inside the center of the first linkage as in FIG. 6. This occurs after the pivot point 29*a* has lowered and returned for a very short distance on its radius past the mid position. This point is indicated in broken line position in FIG. 5. After this point in the cycle is reached, the carriage is no longer under the positive control of the linkage and may be raised or lowered freely. It will be remembered that until this point is reached on an upstroke, the carriage is raised by reason of engagement of the intermediate arcuate bearing 32 of the linkage D against its radius 24. After the attainment of such release from the positive movement by the linkage and the carriage is lowered slightly beyond mid position, the carriage and the receptacle carried thereby are lowered by gravity. After passing this point, the carriage may be pulled manually upwardly to return to the point just below mid position or it may be lowered further by gravity.

This action serves as a safety feature because the cylinder can retract without the unit coming down if an obstruction is encountered by the can. This may occur as a result of a rock or limb or other obstruction being beneath the can, or the can may be merely lowered to a raised surface adjoining a ditch and the like. In any event, damage to the can and the operating mechanism is thus avoided.

A simplified and inexpensive linkage which conserves space due to the sequential action of the independently operated first and second links is thus achieved. Positive locking action of the latching mechanism is achieved by the cylinder so as to properly position the can and an additional function is achieved through the linkage which serves as a safety device to avoid damage as when the receptacle encounters an obstruction on its return cycle.

It is further seen that by shifting the lifting radius of the linkage, lifting power is increased and the stroke of the expansible fluid motor is increased or multiplied. Latching of the receptacle upon the tilting carried is actuated through means providing a knee action that eliminates latching hook overtravel. The lifting mechanism incorporates a safety feature to prevent can damage. The lift unit will yield if the can meets an obstruction on the donwward cycle due to the fact that there is no positive connection between the linkage and the fluid motor when positioned below the mid or intermediate position. When above intermediate position, an additional advantage is afforded due to the fact that the parts are in locked position in that the carriage may not be lowered except through positive movement of the hydraulic or fluid mechanism. When below intermediate position, the carriage is in effect lowered by gravity against the support offered by the cylinder.

While a preferred embodiment of the invention has been described using specific terms, such description is for illustrative purposes only, and it is to be understood that changes and variations may be made without departing from the spirit or scope of the following claims.

What is claimed is:

1. Receptable dumping apparatus attachable to a refuse truck and the like comprising:

an upright mounting support attachable to said truck;

a carriage for carrying a receptacle for dumping into said truck pivotally carried by said support;

a cylinder carried for pivotal movement by said support having extensible means;

a first link having pivotal connection adjacent one end on said support for raising said carriage;

a second link pivotally connected to said first link adjacent one end and being pivotally connected for raising said carriage and the receptacle carried thereby on the other end;

said first and second links being pivotally connected to said extensible means; and said first link and said second link being movable by said extensible means sequentially by said cylinder wherein said second link is raised following pivoted movement of said first link to an intermediate position positioning said carriage in position preparatory to dumping a receptacle carried thereby.

2. The structure set forth in claim 1 including a latch slidable on said carriage for securing said receptacle responsive to raising said second link.

3. The structure set forth in claim 2 including a lost motion coupling connecting said second link and said latch.

4. The structure set forth in claim 1 including a stop member carried by said support limiting pivotal movement of said cylinder at said intermediate position.

5. The structure set forth in claim 1 wherein said second link is pivoted on the inside of a line passing through the pivot point of said cylinder and a remote pivot point of said second link.

6. Receptable dumping aparatus attachable to a refuse truck and the like comprising:

an upright mounting support attachable to said truck;

a carriage for carrying a receptacle for dumping into said truck pivotally carried by said support;

a cylinder carried by said support having extensible means;

linkage means connected to said extensible means for raising said carriage and the receptacle carried thereby responsive to movement of said extensible means;

a latch slidable on said carriage for securing said receptacle upon said carriage responsive to said linkage means; and a lost motion coupling connecting said linkage means to said latch and for raising said carriage for dumping.

7. The structure set forth in claim 6, wherein said lost motion coupling includes a pair of links pivotally connected in end-to-end relation between said carriage and said latch, and a block sliding on said pair of links connected to said linkage means.

8. Receptacle dumping apparatus attachable to a refuse truck and the like comprising:

an upright mounting support attachable to said truck;

a carriage for carrying a receptacle for dumping into said truck pivotally carried by said support;

a cylinder carried for pivotal movement by said support having extensible means;

a first link having pivotal connection adjacent one end on said support;

a second link pivotally connected to said first link adjacent one end and being pivotally connected for raising said carriage and the receptacle carried thereby on the other end;

said first and second links being pivotally connected to said extensible means; and an intermediate arcuate bearing member carried by said first link;

a pin carried by said support engagable by said arcuate bearing member; and said links being movable by said extensible means sequentially by said cylinder wherein said second link is raised following pivoted movement of said first link to an intermediate position whereupon said arcuate bearing member leaves said pin positioning said carriage in position preparatory to dumping a receptable carried thereby.

9. The structure set forth in claim 8 including a latch slidable on said carriage for securing said receptacle responsive to raising said second link, a stop member carried by said support limiting pivotal movement of said cylinder at said intermediate position, and a lost motion coupling connecting said second link and said latch.

10. The structure set forth in claim 1 wherein said second link is pivoted on the inside of a line passing through the pivot point of said cylinder and a remote pivot point of said second link.

* * * * *